US005603271A

United States Patent [19]

Reinhart et al.

[11] Patent Number: 5,603,271

[45] Date of Patent: Feb. 18, 1997

[54] RETRACTABLE SEAM GAUGE FOR SEWING MACHINE AND PNEUMATIC SPACING ADJUSTMENT

[75] Inventors: Terry L. Reinhart, Findlay; Vaughn J. Piper, Elida, both of Ohio

[73] Assignee: Findlay Industries, Inc., Fostoria, Ohio

[21] Appl. No.: 419,242

[22] Filed: Apr. 10, 1995

[51] Int. Cl.[6] ..... D05B 35/10

[52] U.S. Cl. ..... 112/153

[58] Field of Search ..... 112/136, 141, 112/153, 322, 51, 144

[56] References Cited

U.S. PATENT DOCUMENTS

| | | | |
|---|---|---|---|
| 968,346 | 8/1910 | Hamlin | 112/153 |
| 2,971,483 | 2/1961 | Cordier | 112/153 X |
| 2,977,908 | 4/1961 | Winz et al. | 112/153 |
| 3,020,864 | 2/1962 | Katz | 112/153 |
| 3,726,240 | 4/1973 | Emich | 112/322 X |
| 3,875,881 | 4/1975 | Marforio | 112/153 |
| 3,949,689 | 4/1976 | Galya et al. | 112/153 X |
| 3,986,467 | 10/1976 | Hornkohl | 112/153 X |
| 4,813,364 | 3/1989 | Boser | 112/153 X |
| 4,854,254 | 8/1989 | Hsing | 112/322 X |
| 5,331,910 | 7/1994 | Mukai et al. | 112/322 X |

FOREIGN PATENT DOCUMENTS

| | | | |
|---|---|---|---|
| 621850 | 6/1961 | Italy | 112/153 |
| 2009264 | 6/1979 | United Kingdom | 112/153 |

*Primary Examiner*—Ismael Izaguirre

*Attorney, Agent, or Firm*—Kremblas, Foster, Millard & Pollick; Sidney W. Millard

[57] ABSTRACT

A piston and cylinder combination is mounted on the backside of a sewing machine and a piston rod projects from the cylinder toward the bed plate of the sewing machine intermediate the sewing machine head and the support standard. At the lower end of the piston rod is a seam gauge or guide to abut one edge of fabric being sewn by a needle. Retraction of the piston rod retracts the seam gauge from close proximity to the needle and bed plate. The piston and cylinder combination is mounted on a track secured to the back of the sewing machine. The piston and cylinder combination is movable transversely on the track for adjusting the spacing between the seam gauge and the needle.

15 Claims, 2 Drawing Sheets

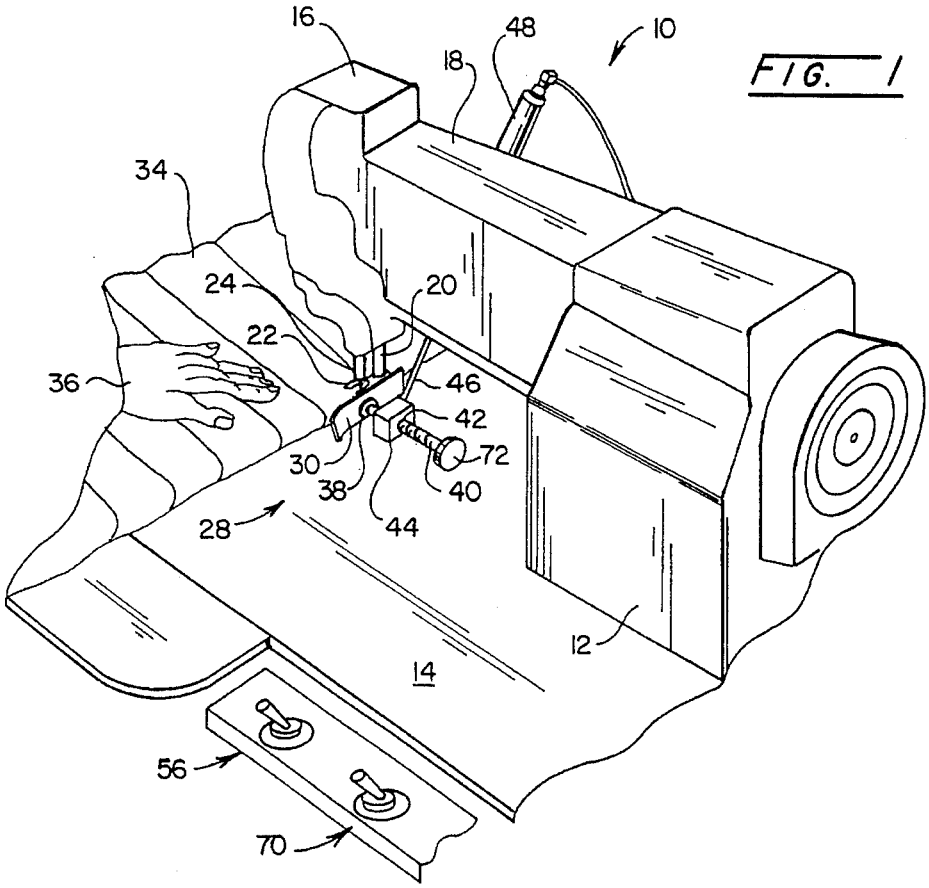
FIG. 1
FIG. 2
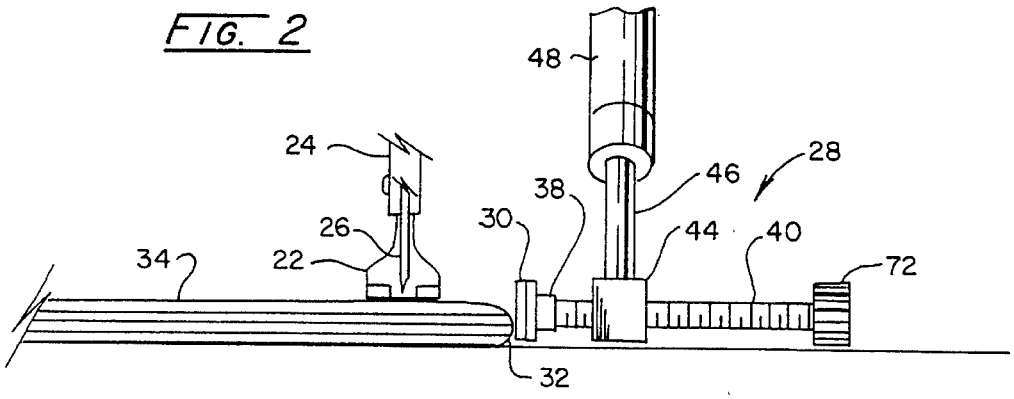

RETRACTABLE SEAM GAUGE FOR SEWING MACHINE AND PNEUMATIC SPACING ADJUSTMENT

FIELD OF THE INVENTION

This invention relates to removing and adjusting the location of seam guides with respect to a sewing machine needle.

BACKGROUND OF THE INVENTION

Seam gauges or guides have been used by sewing machine operators for many years to assist in forming seams of uniform width from the edge of sewn fabric. An example of a conventional seam guide is shown and described in U.S. Pat. No. 968,346. The guide is secured by a bolt and nut combination to the bed plate of the sewing machine and is adjustable transversely by the operator to control the width of the seam from the edge of the fabric. The seam guide is supported on the bed plate by a slotted flat member clamped to the bed plate by tightening the nut on a bolt or stud, the bolt projecting upwardly from the bed plate through the slot in the flat plate. To adjust the seam gauge, the nut is loosened which allows movement of the flat plate transversely of the needle with the threaded stud projecting upwardly through the slot in the flat plate. When a suitable location is found for the seam gauge, the nut is retightened to hold the seam gauge rigidly in position.

This hand operation, as described in U.S. Pat. No. 968,346, is time consuming and in commercial operations it may present an undesired obstruction in the area between the needle and the sewing machine support standard. Often it is desired to turn fabric being sewn to change the direction of the seam by an angle up to 90°. When that occurs the already sewn material or the trailing portion thereof may be turned into the vacant space between the needle and the sewing machine support standard. In order to do this, the seam guide must be removed to prevent the fabric from snagging.

An additional problem is the time it takes to adjust the spacing of the seam guide from the needle. For example, in many commercial operations the width of the seam may be ¼ inch or one inch (0.6–2.5 cm) and repetitive sewing operations may require a shift from one width to another to perform the desired sewing operation. With the hand operation described above in U.S. Pat. No. 968,346, the bolt or nut must be loosened, the seam guide shifted to the proper width and the bolt retightened every time a seam is sewn. The need for a fast and easy automatic spacing apparatus is obvious.

U.S. Pat. No. 2,977,908 makes an attempt to mount and remove a seam guide by pneumatic apparatus but it is highly cumbersome to operate and the apparatus is somewhat complicated. What the disclosed apparatus does not do is remove the seam guide from between the needle and the standard to provide an unobstructed flat surface for the manipulation of previously sewn fabric which may be rotated into that flat area. It does have a piston and cylinder combination to operate in combination with a lever for pivoting a guide into place and out of place. The guide pivots about a vertical axis rigidly secured to the upper surface of the bed plate.

The U.S. Pat. No. 3,020,864 discloses two pivotal seam guides which are both mounted on a bracket secured to a presser foot bar. Both seam guides comprise a bar and a flat blade projecting transversely from the presser foot bar toward the sewing machine head mounting standard and downwardly toward the bed plate. In order to adjust each of the seam gauge bars a set screw is loosened and the bar set to the desired spacing; in the example above, one could be spaced at one half inch (1.3 cm) and the other at one inch (2.5 cm) from the needle. In order to move the two seam gauges out of the area between the needle and the sewing machine support standard, the two seam gauges are pivoted upward toward the operator of the machine, thereby providing an obstructed flat surface for the rotation of the sewn fabric. The problem is that each of these blades forming the seam guide is tremendously dangerous to the operator who might bend forward and jam one of the blades into her face or her eye. As a result the proposed apparatus is totally unsuitable for sewing machine operations. It solves one problem but creates another which is completely unacceptable.

U.S. Pat. No. 3,875,881 discloses a separating guide for fabric layers in combination with a seam guide to be mounted on a bed plate intermediate the sewing machine needle and the standard supporting the sewing machine head. The seam guide disclosed in the patent does not move. But the two fabric separating plates are mounted to slide back and forth toward the needle and the movement is effected by a pneumatic piston and cylinder combination. The patent does not disclose, but it is obvious that the seam gauge could be reciprocated by the same piston and cylinder combination. What the disclosed structure does not do is provide a mechanism automatically operated to set and remove the seam guide from within the work area when it is unnecessary for conventional operations.

What is needed is a seam guide which may be conveniently and quickly removed from the work area when necessary and reinstalled at a specific spacing with respect to the sewing machine needle by the operator with a minimum of time and effort. It is further desirable to have a piece of apparatus which can be adjusted by the operator with a minimum of time and effort at a plurality of preset spacings.

SUMMARY OF THE INVENTION

This invention solves the aforementioned problems by mounting the seam gauge or guide on the lower end of a piston rod which projects from a cylinder in a piston and cylinder combination where the piston rod may be retracted vertically in response to a pneumatic switch.

A first piston and cylinder combination is mounted on a bracket secured to the backside of the sewing machine. Thereby, when the seam guide is retracted by the upward movement of the piston rod, the bed plate of the sewing machine is completely unobstructed, allowing the sewn or unsewn fabric to be moved about the bed plate without a likelihood of snagging on the seam guide.

In another embodiment, the mounting on the back side of the sewing machine is accomplished through a track mounted in a horizontal line on the back of the sewing machine and a second piston and cylinder combination is pneumatically actuated to adjust the first piston and cylinder combination at two or more transverse locations with respect to the sewing machine needle. Thereby manual manipulation of a switch or switches adjusts the spacing of the first piston and cylinder combination in a transverse direction and another switch causes the piston rod of the first piston and cylinder combination to move up or down to specifically place the seam guide at the desirable spacing adjacent the bed plate.

A further means for adjusting or "fine tuning" the location of the seam guide is to mount it on one end of a threaded stud. The threaded stud projects through a cooperatively threaded hole in a block at the lower end of the piston rod. Thereby manual turning of the stud allows a fine tuning of the spacing of the seam gauge from the needle.

In some instances the seam gauge may comprise a lengthy rectangular plate and to prevent its rotation with the threaded stud, it is desirable to mount the seam guide on a swivel at the end of the stud.

Objects of the invention not understood from the above will be fully appreciated upon a review of the drawings and the description of the preferred embodiments which follow.

BRIEF DESCRIPTION OF THE DRAWINGS

FIG. 1 is a perspective view of a sewing machine with the seam guide in operative position according to this invention;

FIG. 2 is a fragmentary front elevational view of the seam guide, needle and fabric to be sewn as illustrated in FIG. 1;

DETAILED DESCRIPTION OF THE PREFERRED EMBODIMENTS

Figure 3:
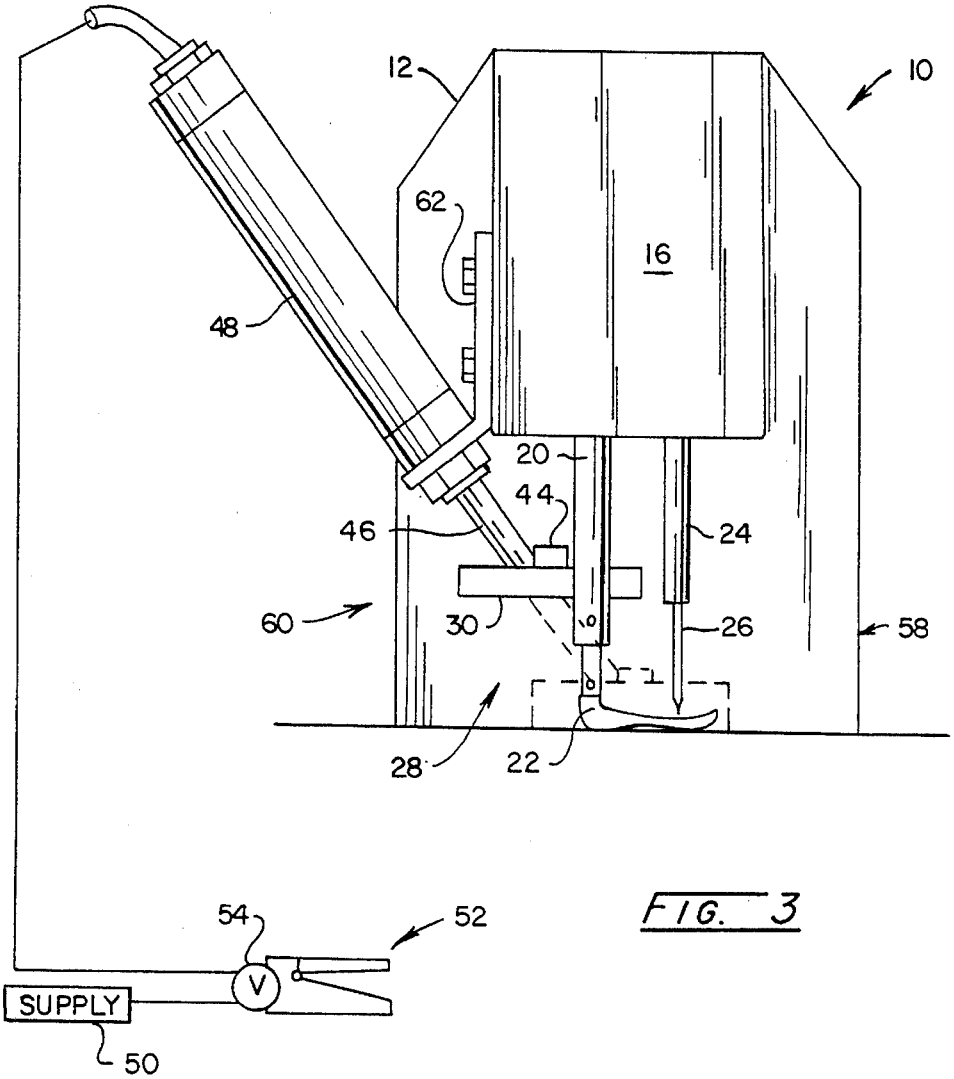
FIG. 3 is a left-hand side elevational view of the sewing machine and seam gauge of FIG. 1, shown partially schematically.

FIG. 1 illustrates a sewing machine 10 with a support standard 12 projecting upwardly from a bed plate 14. Support standard 12 supports a sewing machine head 16 at one end of a support arm 18.

Projecting downwardly from head 16 is a retractable presser foot bar 20 which reciprocates vertically by hand manipulation of the operator to lift and lower a presser foot 22 in conventional fashion.

Just forward of presser foot bar 20 is a needle bar 24 which supports a reciprocating needle 26 in conventional sewing machine fashion.

The above described apparatus is conventional in the field and this invention is designed to combine with this conventional apparatus to provide a unique combination. The structure supplied by this invention is a unique seam guide or gauge 28 to be used in this combination.

In the preferred embodiment a flat plate 30 with a tapered or curved surface at its forwardmost end serves to guide the edge 32 of fabric 34 as it is fed by hand 36 under presser foot 22 to be sewn by needle 26 and thread (not shown).

Seam gauge 30 is supported by a swivel 38 on one end of a threaded stud 40 which extends through a matingly threaded opening 42 in a block 44 secured at the lower end of a piston rod 46.

Figure 4:
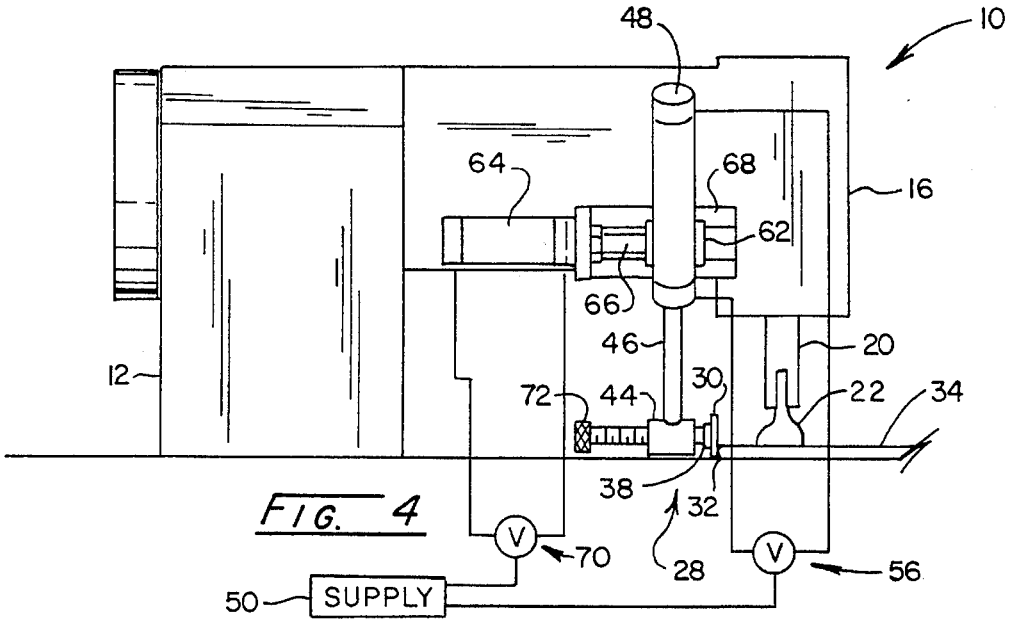
FIG. 4 is a rear elevational view of the seam gauge and sewing machine of FIG. 1, shown partially schematically.

Piston rod 46 projects from a first piston and cylinder combination 48 to move the seam gauge 30 vertically downward into position (as shown in FIGS. 1, 2 and 4 and in phantom in FIG. 3) and vertically upward, retracted out of position (as shown in FIG. 3). The piston and cylinder combination 48 is connected to a source 50 of pneumatic fluid under pressure. Actuation of the piston and cylinder combination 48 to raise or lower seam guide 30 is accomplished through a foot switch 52 as shown in FIG. 3 which opens or closes a valve 54 to deliver or cut off pneumatic pressure from supply 50. Piston and cylinder combination 48 serves as a lifter or depressor for rod 46 and other lifters could function adequately, for example, an electrically actuated magnet, but pneumatic apparatus is preferred.

An alternative switching and valve mechanism to raise and lower seam guide 30 is schematically illustrated at 56 in FIG. 4 which may be hand operated by the operator from a location such as is illustrated in FIG. 1.

As illustrated in FIG. 1, the fabric 34 to be sewn passes from the front side 58 of sewing machine 10 under the needle 26 and presser foot 22 to the backside 60. The piston and cylinder combination 48 is shown mounted on the backside 60 of the sewing machine by a bracket 62. Because bracket 62 is on the backside of the machine, retraction of piston rod 46 lifts the guide 30 upwardly and backwardly to remove it from the area between needle 26 and standard 12 to allow easier manipulation of the fabric 34 within that area. The pneumatic lifting and lowering of guide 30 provides quick operation to clear the area and a guaranteed identical location for the guide 30 upon its return to guiding position as illustrated in FIG. 2. Further, the rearward lifting of guide 30 removes it from the work area and minimizes hand or facial injury to the operator during manipulation of fabric 34.

An additional feature of this invention comprises a second piston and cylinder combination 64. A second piston rod 66 projects from combination 64 horizontally along the back 60 of the sewing machine and is secured to the bracket 62 mounting the first piston and cylinder combination 48 thereon. The second piston and cylinder combination 64 is mounted to move mounting bracket 62 and piston and cylinder combination 48 transversely along a track 68. Thereby, the transverse spacing of guide 30 from needle 26 is controlled or adjusted by a manually operated switch and valve combination 70 connected to the supply of pneumatic pressure 50. The switch and valve combination 70 may be manipulated to move the guide 30 transversely to two or more locations along track 68 as desired.

An additional horizontal adjustment mechanism is provided for seam guide 30 as illustrated best in FIG. 2. Threaded stud 40 is supported in block 44 which holds the guide 30 in position for fine tuning manipulation of seam guide 30. A gnarled handle 72 may be turned manually to advance or retract guide 30 with respect to needle 26.

The internal structure of piston and cylinder combinations 48 and 60 is not illustrated because it could be of various combinations, all of which are conventional. For example, a coil spring could bias the piston in combination 48 downward to locate the guide 30 adjacent needle 26. Retraction could occur by actuating switch 56 to open valve 54 to charge the cylinder and overcome the force of the spring bias. The opposite orientation of the spring is equally appropriate or the piston could be moved solely by pneumatic pressure applied to one side of the piston and then the other side.

Having described the invention in its preferred embodiments, it will be clear to those having ordinary skill in the art that modifications may be made to the invention without departing from the spirit thereof. Accordingly, such modifications are incorporated herein by reference. The illustrations in the drawings and the words used to describe the same are not intended to be limiting on the invention, rather it is intended that the invention be limited only by the scope of the appended claims.

We claim:

1. In combination, a sewing machine and a seam gauge, comprising, a sewing machine having a bed plate supporting a standard, said standard having a transversely extending arm terminating in a head, said head supporting a presser foot on a presser foot bar and a needle on a needle bar, said machine having a front side to receive fabric for sewing by said needle and a back side for the exit of sewn fabric, said fabric having a side edge between said needle and said standard, a first piston and cylinder combination mounted on said back side, a piston rod projecting from said cylinder toward said plate at a location between said standard and said presser foot, a seam gauge for engaging said edge of said fabric, said gauge being mounted on said rod to reciprocate between (1) a position adjacent said needle near said plate and (2) a position retracted vertically from said plate and toward said sewing machine back side to provide a space between said standard and said needle which is unobstructed by said seam gauge.

2. The combination of claim 1 including a source of fluid under pressure connected to said piston and cylinder to bias said piston rod in one direction, a switch to open and close a valve to connect and disconnect said fluid to said piston and cylinder.

3. The combination of claim 2 including an adjustor for adjusting the horizontal distance from said needle to said seam gauge.

4. The combination of claim 3 wherein said adjustor comprises a threaded stud extending through an opening in a block secured to said rod, said opening having mating threads to receive said threaded stud, said seam gauge being mounted on an end of said stud between said block and said needle.

5. The combination of claim 4 wherein said adjustor further includes a second piston and cylinder combination operatively connected to said first piston and cylinder combination to move said first piston and cylinder combination transversely in a horizontal direction with respect to said sewing machine head.

6. The combination of claim 5 wherein said seam gauge is mounted on said stud by a swivel.

7. The combination of claim 6 wherein said first piston and cylinder combination is secured on a horizontal track mounted on the back side of said sewing machine.

8. The combination of claim 1 including an adjustor for adjusting the horizontal distance from said needle to said seam gauge.

9. The combination of claim 8 wherein said adjustor comprises a threaded stud extending through an opening in a block secured to said rod, said opening having mating threads to receive said threaded stud, said seam gauge being mounted on an end of said stud between said block and said needle.

10. The combination of claim 9 wherein said adjustor further includes a second piston and cylinder combination operatively connected to said first piton and cylinder combination to move said first piston and cylinder combination transversely in a horizontal direction with respect to said sewing machine head.

11. The combination of claim 8 wherein said adjustor comprises a second piston and cylinder combination operatively connected to said first piston and cylinder combination to move said first piston and cylinder combination transversely in a horizontal direction with respect to said sewing machine head.

12. In combination, a sewing machine and a seam gauge, comprising, a sewing machine having a bed plate supporting a standard, said standard having a transversely extending arm terminating in a head, said head supporting a presser foot on a presser foot bar and a needle on a needle bar, said machine having a front side to receive fabric for sewing by said needle and a back side for the exit of sewn fabric, said fabric having a side edge to be located between said needle and said standard, a rod mounted on the back side of said sewing machine and extending toward said plate between said standard and said needle, said rod supporting a seam gauge for engaging said edge of said fabric, an adjustor for adjusting the horizontal distance from said needle to said seam gauge, said rod being mounted to reciprocate on a horizontal track secured to the back side of said sewing machine, and a pneumatically operated piston and cylinder combination for driving said rod along said track.

13. The combination of claim 12 including a rod lifter for moving said seam guide vertically with respect to said plate.

14. The combination of claim 13 including a threaded stud extending through an opening in a block secured to said rod, said opening including mating threads to receive said threaded stud, said seam gauge being mounted on said stud intermediate said needle and said rod.

15. The combination of claim 12 including a threaded stud extending through an opening in a block secured to said rod, said opening including mating threads to receive said threaded stud, said seam gauge being mounted on said stud intermediate said needle and said rod.

* * * * *